US007044708B2

(12) United States Patent
Hausknecht

(10) Patent No.: US 7,044,708 B2
(45) Date of Patent: May 16, 2006

(54) GUIDE DEVICE FOR AN EXHAUST GAS TURBOCHARGER

(75) Inventor: Josef Hausknecht, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 60 days.

(21) Appl. No.: 10/820,725

(22) Filed: Apr. 9, 2004

(65) Prior Publication Data

US 2004/0202538 A1 Oct. 14, 2004

(30) Foreign Application Priority Data

Apr. 10, 2003 (DE) ..... 103 16 389

(51) Int. Cl.
*F03B 3/18* (2006.01)

(52) U.S. Cl. ..... 415/1; 415/163; 415/160

(58) Field of Classification Search ..... 415/1, 415/159, 160, 163, 164, 165
See application file for complete search history.

(56) References Cited

U.S. PATENT DOCUMENTS

| | | | | |
|---|---|---|---|---|
| 2,441,427 | A * | 5/1948 | Lincoln | 415/163 |
| 4,695,200 | A * | 9/1987 | Hall et al. | 415/9 |
| 6,220,031 | B1 * | 4/2001 | Daudel et al. | 60/602 |
| 6,779,971 | B1 * | 8/2004 | Garrett | 415/156 |

FOREIGN PATENT DOCUMENTS

| | | | |
|---|---|---|---|
| DE | 20114367 | U1 | 2/2003 |
| EP | 0227475 | A2 * | 7/1987 |

* cited by examiner

*Primary Examiner*—Edward K. Look
*Assistant Examiner*—Nathan Wiehe
(74) *Attorney, Agent, or Firm*—Crowell & Moring LLP

(57) ABSTRACT

A guide device for an exhaust gas turbocharger has a geometry which is variable. The guide device includes guide blades, blade levers which are connected to particularly assigned guide blades in a rotationally fixed manner, and a setting ring in which the blade levers are mounted via a spring element.

8 Claims, 3 Drawing Sheets

GUIDE DEVICE FOR AN EXHAUST GAS TURBOCHARGER

This application claims the priority of German application 103 16 389.1, filed Apr. 10, 2003, the disclosure of which is expressly incorporated by reference herein.

This invention relates to a guide device for an exhaust gas turbocharger with a geometry which is variable, including guide blades for determining a momentum with which exhaust gas acts upon a turbine of the exhaust gas turbocharger, blade levers which are connected to particularly assigned guide blades in a rotationally fixed manner, and a setting ring in which the blade levers are mounted, and in which the blade levers and the guide blades are rotated by rotation of the setting ring.

German Utility Model DE 201 14 367 U1 describes a guide device for an exhaust gas turbocharger which includes as essential components a plurality of guide blades for determining the momentum with which the exhaust acts upon the turbine, a setting ring and an external adjusting lever. Each guide blade is connected to a blade lever in a rotationally fixed manner. The blade lever is in turn guided in a form-fitting connection in a groove of the setting ring. Consequently the angular position of the blade lever changes by rotation of the setting ring and thus the position of the guide blades also changes. The adjusting ring/blade lever connecting point is critical because the components must have appropriate play between them. The reason lies in the functionality, i.e., the transfer of the rotational motion and the thermal expansion. This play in turn causes a deviation to occur between the setpoint variable and the actual variable, i.e., the angular position of the guide blades. To this extent the positional accuracy is problematical. Because of the play between the adjusting ring and the blade levers, it is possible that the adjusting device will resonate in certain operating ranges of the exhaust gas turbocharger.

An object of this invention is to design a guide device having a high positional accuracy.

This object is achieved by having the blade levers mounted in the setting ring by a spring element. Certain embodiments are reflected in dependent claims. A process of operating the guide device is also claimed.

According to this invention, the blade levers are mounted via a spring element in the setting ring. The spring element here is in friction-locked contact with the blade lever. The spring element includes a first leg and may be supplemented by a second leg. In addition, an angle of rotation limitation is provided. In practice, the setting ring and the spring element are designed in one piece.

Because of the spring load on the blade lever, the configuration is self-adjusting. For this connection point, consequently, a greater manufacturing tolerance may be allowed. This causes a reduction in manufacturing costs. On the whole, this yields an advantage for the present invention in that the guide device is free of play and thus has a low setpoint-actual deviation.

BRIEF DESCRIPTION OF THE DRAWINGS

The drawings illustrate a preferred exemplary embodiment.

DETAILED DESCRIPTION OF THE INVENTION

Figure 1:
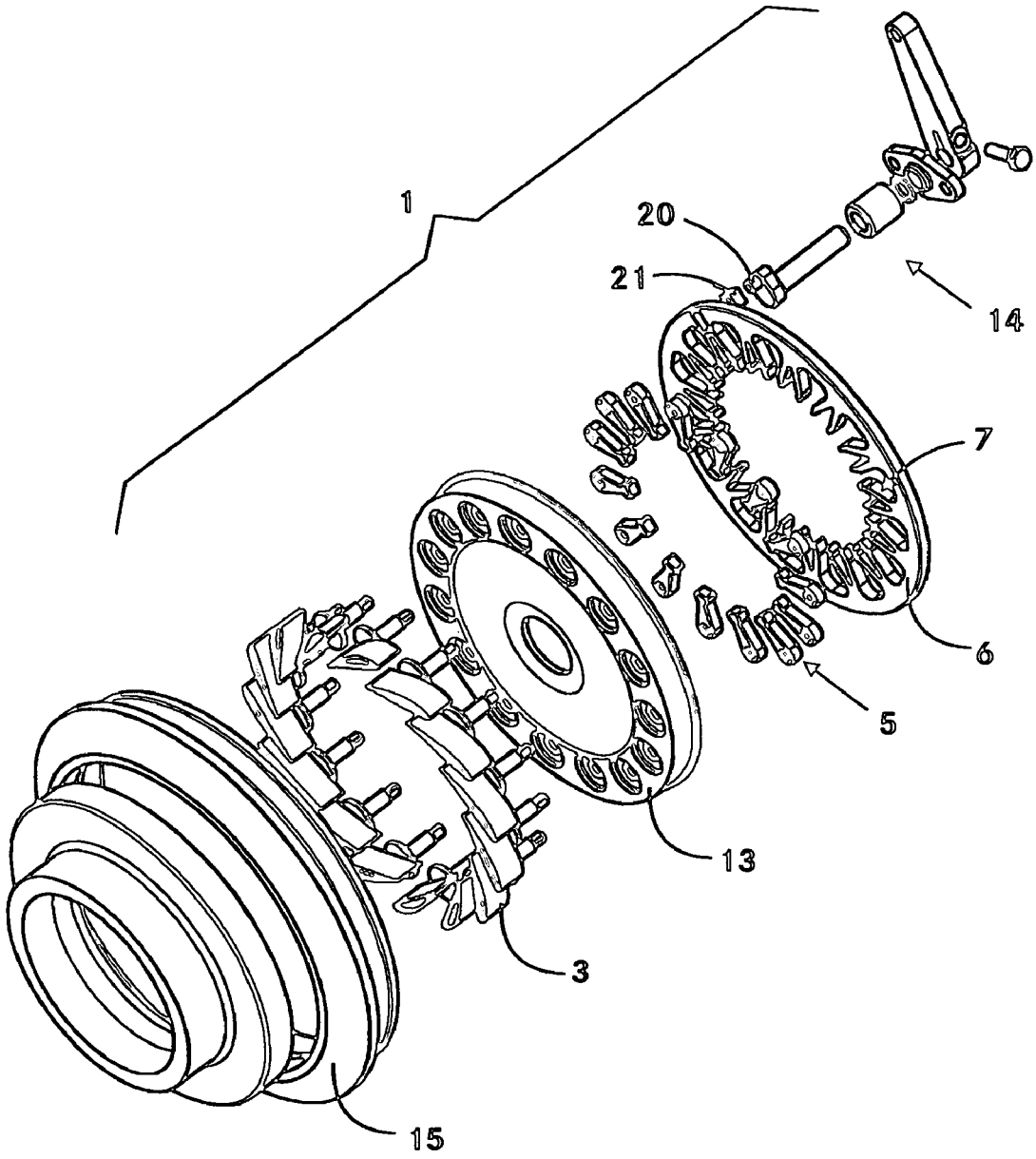
FIG. 1 shows the guide device in an exploded view.

FIG. 1 shows the guide device 1 as an exploded drawing. The guide device 1 includes a plurality of guide blades 3, a carrier ring 13, a plurality of blade levers 5, a setting ring 6 and an adjusting lever with a shaft 14. FIG. 1 also shows a turbine casing 15 in which there is a turbine. The guide blades 3 are mounted on the carrier ring 13. The carrier ring 13 is stationary with respect to a bearing casing of the exhaust gas turbocharger. Each guide blade 3 is connected to a blade lever 5 in a rotationally fixed manner. The blade levers 5 are in turn mounted in the setting ring 6 via a spring element 7 without any play. The spring element 7 and the setting ring 6 are designed in one piece in the diagram according to FIG. 1.

The setting ring 6 is also rotated by the rotation of the adjusting lever with the shaft 14. The rotation of the setting ring 6 is transmitted via the spring element 7 to the blade levers 5 so that the angular position of the guide blades 3 changes. The angular position of the guide blades 3 determines the momentum with which the exhaust gas acts on the turbine.

Figure 2:
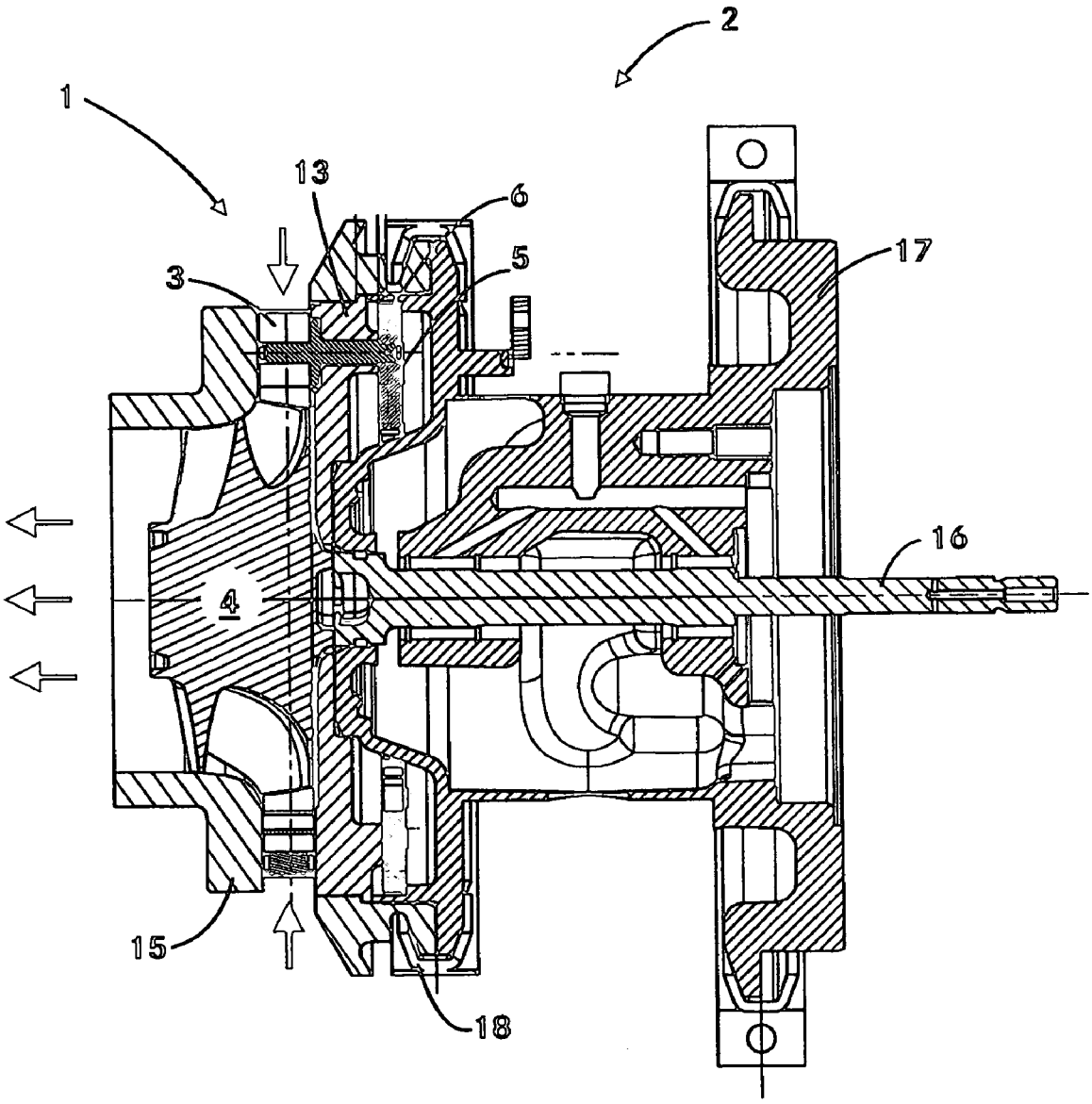
FIG. 2 shows a sectional diagram of the exhaust gas turbocharger.

FIG. 2 shows a sectional diagram of an exhaust gas turbocharger 2 in the area of the turbine 4. It is known that an exhaust gas turbocharger 2 includes a turbine 4 which is connected to a compressor by a shaft 16. The compressor is not shown in FIG. 2. The turbine 4 is situated in the turbine casing 15. The turbine casing 15 is connected to a bearing casing 17. The two casings are interconnected in practice by a V belt 18. The direction of flow of the exhaust gas is depicted by appropriate arrows in FIG. 2. The guide device 1 is situated on the primary side of the turbine 4. The guide blades 3 are inside the turbine casing 15 to change the oncoming flow cross section. The blade lever 5, the spring element 7 and the setting ring 6 are situated inside the bearing casing 17.

Figure 3:
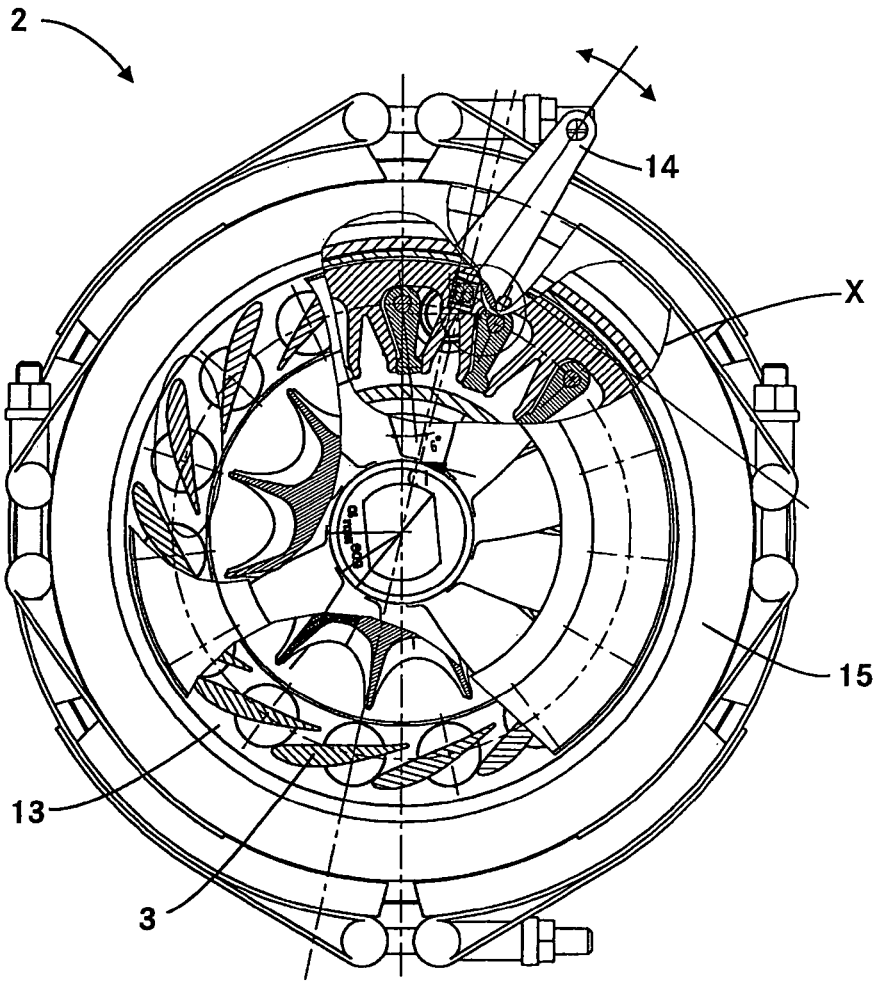
FIG. 3 is a view of the exhaust gas turbocharger from the turbine side.

FIG. 3 shows the exhaust gas turbocharger 2 with a view of the turbine side. The guide blades 3 are shown in the open position in an area above the horizontal axis of symmetry. A corresponding diagram is labeled as X. This diagram is shown on an enlarged scale in FIG. 4. The angular position of the guide blades 3 is predetermined by the adjustment lever with the shaft 14. The pivot angle of the adjusting lever amounts to ±14°, for example. The blade levers 5 are mounted in the setting ring 6 via the spring element 7. This diagram shows a spring element 7 which includes a first leg 8 and a second leg 9. The two legs 8, 9 act upon a section 19 of the blade lever 5 with a spring force. Due to the fact that the legs act on the left side and the right side of the blade lever, this connection point is free of play.

When using a spring element 7 with only one leg, the side of the blade lever 5 which the gas does not act on is guided in a form-fitting manner via a corresponding contour.

To increase the safety of the guide device 1, an angle of rotation limit 11 is provided. The two legs 8, 9 of the spring element 7 form a pocket 12 in the area of the setting ring 6 to this end. The blade lever 5 consequently comes to rest on a stop surface 10 of the legs 8, 9 at a minimum/maximum swivel angle.

Figure 4:
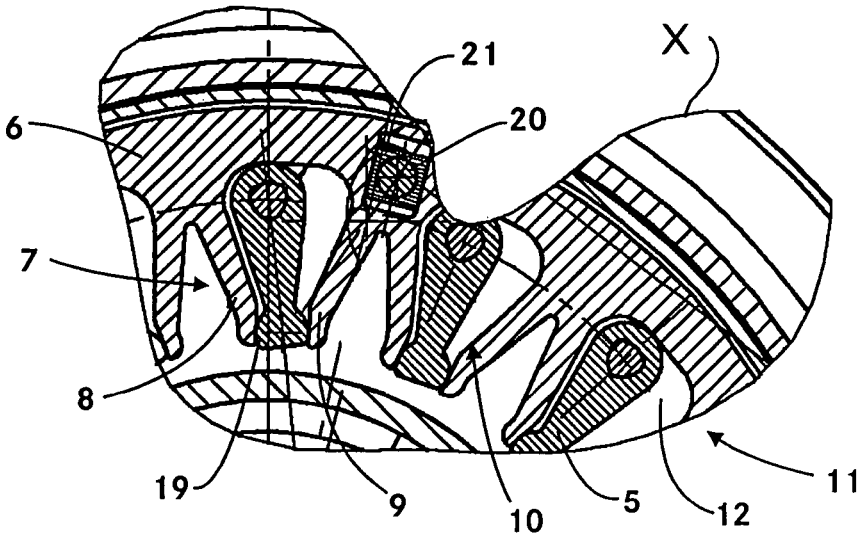
FIG. 4 is a view of detail X of FIG. 3.

In the illustration of FIG. 4, the rotational movement of the adjusting lever with the shaft 14 is transmitted to the setting ring 6 via a crank pin 20 and a sliding piece 21. The crank pin 20 is part of the adjusting lever with the shaft 14 (see FIG. 1). However, the sliding piece 21 is not necessary for the functionality. A spring element may be situated between the crank pin 20 and the setting ring 6. Due to this spring element, the crank pin 20/setting ring 6 connection is free of play. The spring element may be designed like the spring element 7.

The invention yields the following advantages.

The setting ring/blade lever connection is free of play, which increases the adjustment accuracy, a larger manufacturing tolerance may be allowed for the connection, which reduces manufacturing costs, and a long lifetime is achieved.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A guide device for an exhaust gas turbocharger with a geometry which is variable, comprising:

guide blades for determining a momentum with which exhaust gas acts upon a turbine of the exhaust gas turbocharger, blade levers which are connected to particularly assigned guide blades in a rotationally fixed manner, and a setting ring in which the blade levers are mounted, the blade levers and the guide blades being rotated by rotation of the setting ring, wherein the blade levers are mounted in the setting ring by a spring element, wherein the spring element includes a first leg for a unilateral force actuation of one of the blade levers, and wherein the spring element additionally includes a second leg so that the one of the blade levers is acted upon on both sides.

2. The guide device for an exhaust gas turbocharger as claimed in claim 1, wherein the first and second legs have different spring constants.

3. The guide device for an exhaust gas turbocharger as claimed in claim 2, wherein the spring element includes a rotational angle limitation.

4. The guide device for an exhaust gas turbocharger as claimed in claim 1, wherein one of the first and second legs of the spring element has a stop surface for a form-fitting force acting on the blade lever.

5. The guide device for an exhaust gas turbocharger as claimed in claim 1, wherein the spring element includes a rotational angle limitation.

6. A process of operating a guide device for an exhaust gas turbocharger with a geometry which is variable, including guide blades for determining a momentum with which exhaust gas acts upon a turbine of the exhaust gas turbocharger, blade levers which are connected to particularly assigned guide blades in a rotationally fixed manner, a setting ring in which the blade levers are mounted, and a spring element by which the blade levers are mounted in the setting ring, comprising:

rotating the blade levers and the guide blades by rotation of the setting ring, wherein the spring element includes a first leg for a unilateral force actuation of one of the blade levers, and wherein the spring element additionally includes a second leg so that the one of the blade levers is acted upon on both sides.

7. The process as claimed in claim 6, wherein the first and second legs have different spring constants.

8. The process as claimed in claim 6, wherein one of the first and second legs of the spring element has a stop surface for a form-fitting force acting on the blade lever.

* * * * *